United States Patent [19]

Pringle

[11] Patent Number: 4,997,043

[45] Date of Patent: Mar. 5, 1991

[54] WELL LANDING NIPPLE AND METHOD OF OPERATION

[75] Inventor: Ronald E. Pringle, Houston, Tex.

[73] Assignee: Camco International Inc., Houston, Tex.

[21] Appl. No.: 519,194

[22] Filed: May 4, 1990

[51] Int. Cl.[5] ..... E21B 23/02

[52] U.S. Cl. ..... 166/382; 166/66.5

[58] Field of Search ..... 166/382, 66.4, 66.5, 166/208, 217

[56] References Cited

U.S. PATENT DOCUMENTS

| | | | |
|---|---|---|---|
| 3,105,548 | 10/1963 | Ownby | 166/66.4 |
| 3,858,650 | 1/1975 | Mott | 166/224 A |
| 4,058,166 | 11/1977 | Crickmer | 166/66.5 |
| 4,161,219 | 7/1979 | Pringle | 166/324 |
| 4,579,177 | 4/1986 | Going, III | 166/66.5 X |

*Primary Examiner*—William P. Neuder

*Attorney, Agent, or Firm*—Fulbright & Jaworski

[57] ABSTRACT

A landing nipple for use in a well tubing for receiving a well tool. A magnetic armature is utilized in the nipple actuated by a magnet or solenoid coil for extending retractable no-go shoulders and/or locking dogs into the bore of the nipple for coacting with a well tool.

31 Claims, 18 Drawing Sheets

WELL LANDING NIPPLE AND METHOD OF OPERATION

BACKGROUND OF THE INVENTION

In oil and gas wells various types of well tools are placed in the production well bore of the well tubing to perform various functions. For example, such well tools may be safety valves, blanking plugs, monitoring instruments, such as temperature and pressure instruments. These well tools are placed in and retrieved by a conventional wireline or conductor line cable. It is desirable in many cases to have the ability to place multiple well tools at various depths to accomplish an overall objective. Well tools are conventionally set in landing nipples which have a positive stop shoulder, commonly known as a "no-go", and may also have a locking notch for locking the well tools therein. This leads to a complicated installation since in using multiple landing nipples the various "no-gos" must be differently sized to accommodate various operations. In setting well tools in such no-gos, the well tools generally have to be jarred to set and jarred to release which may be undesirable for various reasons.

In addition, various mechanical selective systems have been proposed in which wireline tools survey multiple profiles machined in the landing nipples for selectively landing a well tool in a desired nipple.

SUMMARY

It is an object of the present invention to provide one or more well landing nipples in a well tubing and a method of operating well tools therein to selectively locate well tools as desired. In some embodiments of the present invention this is accomplished without any reduction of the well bore and in some embodiments of the present invention well tools are set and released from the landing nipples without jarring. In various embodiments the landing niPple is provided with extendable and/or retractable locking dogs and/or extendable and retractable no-gos, either or both of which are actuated by a magnetic armature. The armature may be actuated by a permanently affixed solenoid coil in the nipple or by a solenoid coil or magnet run inside the nipple.

Another feature of the present invention is the provision of a landing nipple for connection in a well tubing in which the nipple includes an open bore for alignment with the well tubing. At least one holding shoulder is provided in the nipple and the shoulder is movable out of the nipple bore for allowing well tools to pass therethrough and is also extendable into the nipple bore for engagement with a well tool. Locking means are provided in the nipple for locking the holding shoulder in an extended position in the bore and magnetically actuated means are connected to the locking means and adapted to be actuated from the well surface for unlocking the locking means.

A still further object is wherein the locking means and magnetically actuated means includes a movable magnetic armature having a wedge for engaging, moving and locking and unlocking the holding shoulder with spring means for moving the armature in a direction to lock the holding shoulder in an extendable position in the bore. A solenoid is adapted to actuate the armature for unlocking the locking means and thus only requires energization when being used. In one embodiment, the solenoid is positioned in the nipple. In other embodiments, the solenoid is connected to a line from the well surface and is movable in the bore of the nipple. In other embodiments, a magnet connected to a line from the well surface is movable through the bore for actuating the armature.

A still further object of the present invention is the provision in one embodiment of the invention of a no-go shoulder in the nipple extending inwardly for engaging a well tool. Preferably, the movable holding shoulder is extendable into the bore further than the no-go shoulder.

A still further object of the present invention is the combination of a well tool having a stop shoulder for engaging the no-go shoulder and having a locking recess for receiving the movable holding shoulder. Therefore, the well tool can be set and pulled from the well bore by a magnetic actuation of the holding shoulder without requiring mechanical jarring of the well tool.

Another object of the present invention is the method of setting a well tool having a stop shoulder and a locking recess in a nipple in a well tubing in which the nipple includes a bore, a no-go shoulder extending into the bore, and at least one holding shoulder which is movable out of the bore and is extendable into the bore and which is normally locked in an extended position by locking means. The method includes magnetically energizing and retracting the locking means whereby the holding shoulder may be moved from the bore, lowering a well tool into the well tubing and nipple and positioning the stop shoulder on the no-go shoulder, and magnetically deenergizing the locking means and locking the holding shoulder in an extendable position in the locking recess. The set well tool may be pulled from the well tubing without jarring by magnetically energizing and retracting the locking means and raising the well tool.

A still further object of the present invention is the provision of a landing nipple having at least one first holding shoulder and having at least one second holding shoulder axially spaced from the first shoulder. Each of said shoulders are movable out of the nipple bore and extendable into the nipple bore. First and second locking means are provided for locking the first and second shoulders, respectively, in an extendable position in the bore. Magnetically actuated means are connected to the first and second locking means and are adapted to be actuated from the well surface for unlocking the first and second locking means. Preferably, the magnetic actuated means in one position unlocks one of the locking means and in the second position unlocks the other of the locking means.

Yet a further object of the present invention is the method of setting a well tool having a stop shoulder and a locking recess in a landing nipple including a bore, a no-go shoulder which is movable and extendable into and out of the bore and locking dog means positioned above the no-go shoulder and which are movable and extendable into and out of the bore. The nipple includes first and second releasable locking means for locking and unlocking the dog means and the no-go shoulder, respectively. The method includes magnetically retracting the first locking means for unlocking the dog means and magnetically locking the second locking means for locking the no-go shoulder in an extended position in the bore, lowering the well tool into the well tubing and nipple and positioning the stop shoulder on the no-go shoulder. The method thereafter includes unlocking the second locking means and yieldably urging the first locking means into engagement with the locking dog means. The method may include moving the well tool in the nipple, either upwardly or downwardly, until the locking dog means is aligned with the locking recess.

Another object of the present invention is the provision of a landing nipple having a plurality of holding shoulders and a separate movable magnetic armature including a wedge for engaging, moving, locking, and unlocking each of the holding shoulders. Separate solenoids are provided in the nipple adapted to be energized for seParately actuating each of the armatures for locking the holding shoulders in an extendable position thereby providing a nipple which will engage a well tool even in the event that one of the individual solenoids fail. In addition, the nipple need not be of expensive stainless steel, as the coils may be closely adjacent the armatures allowing the nipple to be of a cheaper material while still actuating the armatures.

Other and further objects, features and advantages will be apparent from the following description of presently preferred embodiments of the invention, given for the purpose of disclosure, and taken in conjunction with the accompanying drawings.

DESCRIPTION OF THE PREFERRED EMBODIMENT

Figure 1:
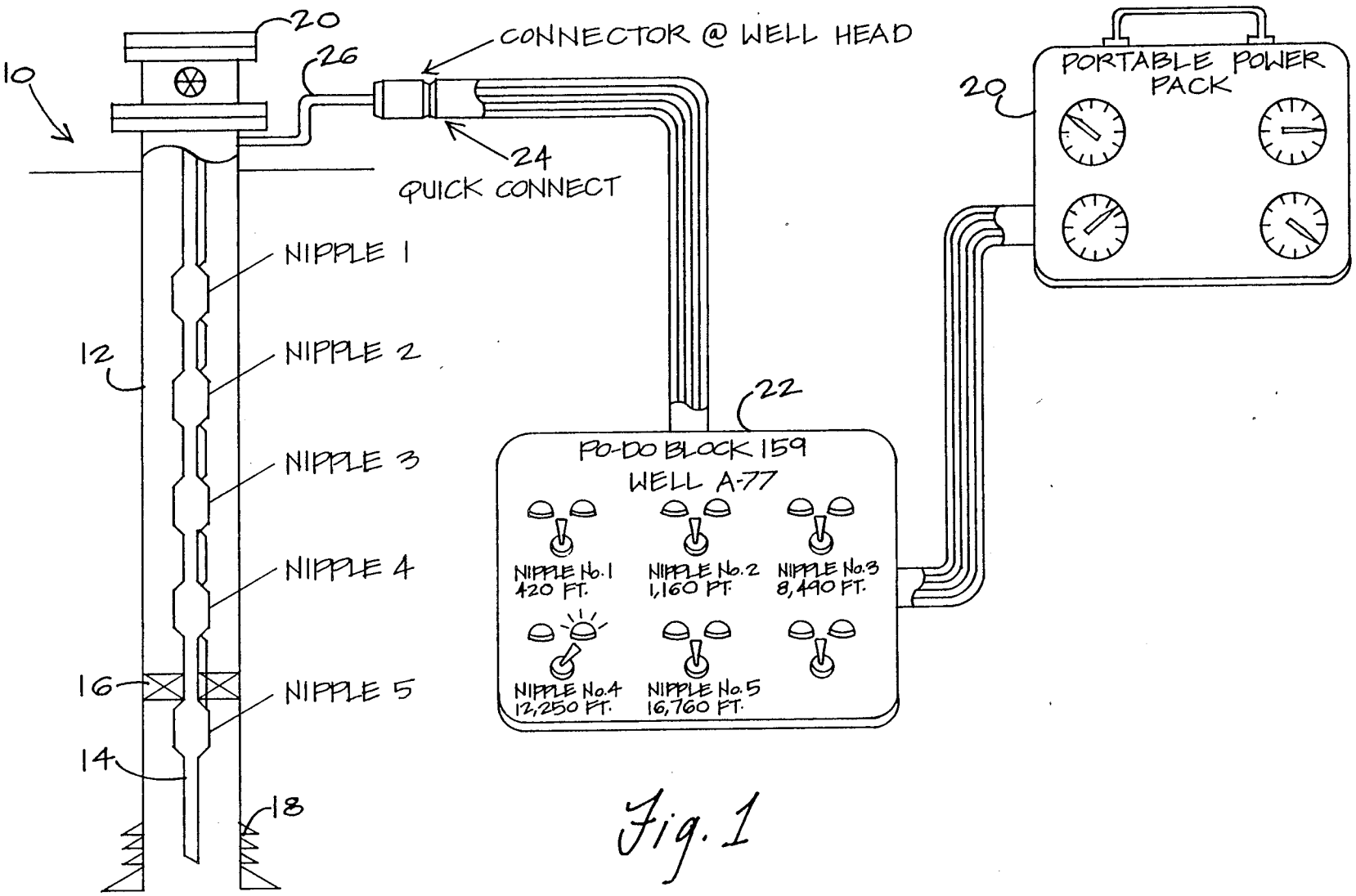
FIG. 1 is a schematic, elevational view, partly in cross section, illustrating the placement and control of a plurality of landing nipples in a well tubing by one embodiment of the present invention.

Referring now to FIG. 1, an oil and/or gas well generally indicated by the reference numeral 10 may include a casing 12, a well tubing 14 and a well packer 16 therebetween. The well tubing or production string 14 carries well production from perforations 18 upwardly to a wellhead 20. As shown, the well tubing 14 may include a plurality of landing nipples, such as nipples 1, 2, 3, 4 and 5. It is frequently desirable to place various well tools, such as safety valves, blanking plugs and measuring instruments, in one or more of the landing nipples.

The above described installation is generally conventional and in the past various different sized no-go shoulders have been employed in each nipple or various mechanical selection systems have been utilized by wireline tools measuring various profiles in the nipple in order to selectively install a well tool in the desired nipple. One feature of the present invention is to provide a landing nipple and method of operation to selectively locate well tools in the bore of the well tubing 14 in the selected nipples. In the preferred embodiment, an electrical line is run from the well surface to the nipples for selectively actuating one or more holding shoulders, such as locking dogs or no-gos, which may be moved out of the bore or extended into the bore for engaging a well tool. In the preferred embodiment, the retractable and extendable locking dogs and no-gos are activated by a solenoid coil which does not require continuous electrical power. In such devices, a portable power pack 20 having a control panel 22 may, when needed, be connected by a quick connect 24 to an electrical line 26 leading to the nipples 1, 2, 3, 4 and 5, for selectively actuation of one or more of the landing nipples for selectively receiving a well tool.

Figure 2A:
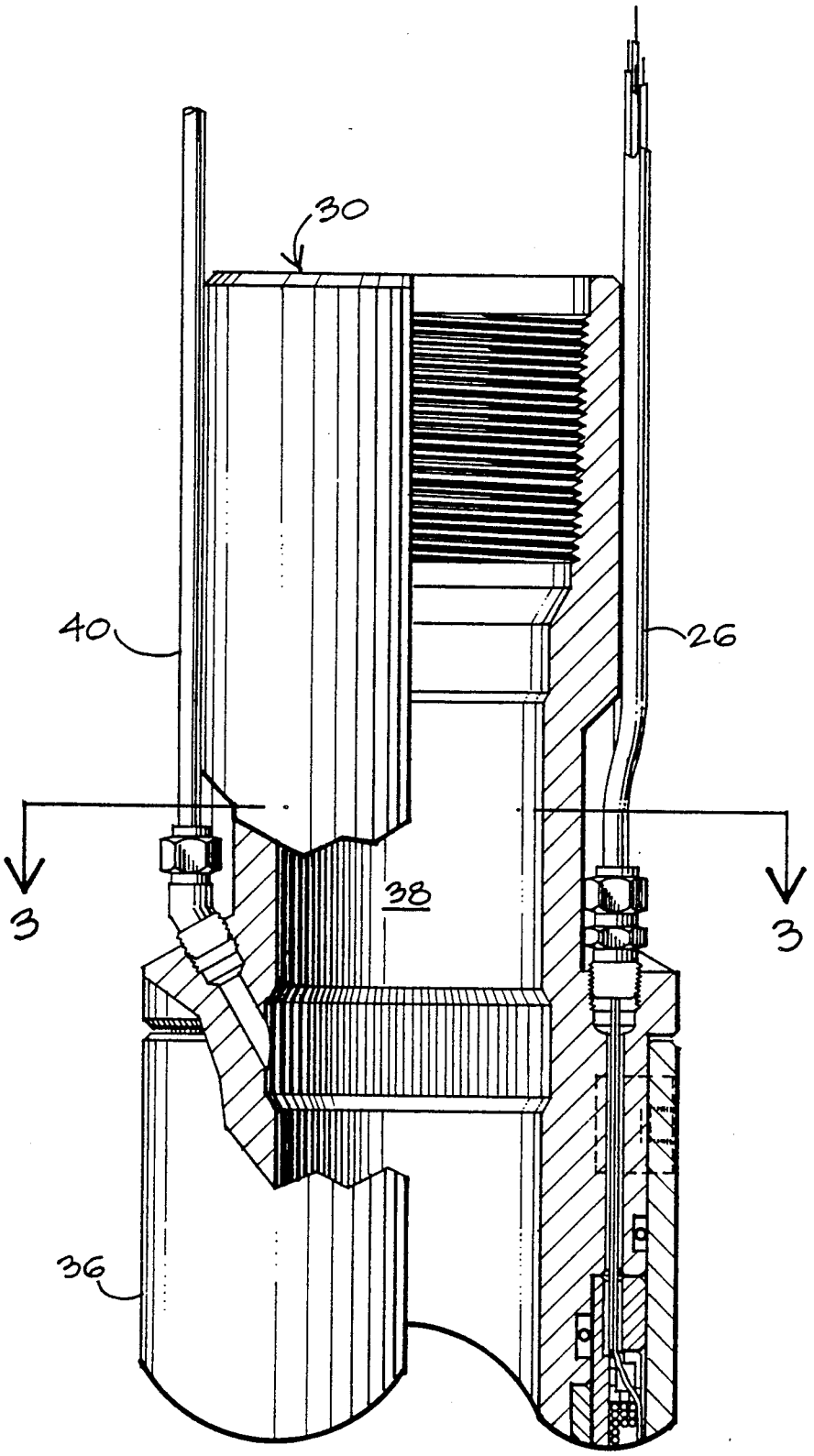
FIGS. 2A and 2B are continuations of each other and are elevational views, in quarter section, illustrating one form of the present invention.
Figure 2B:
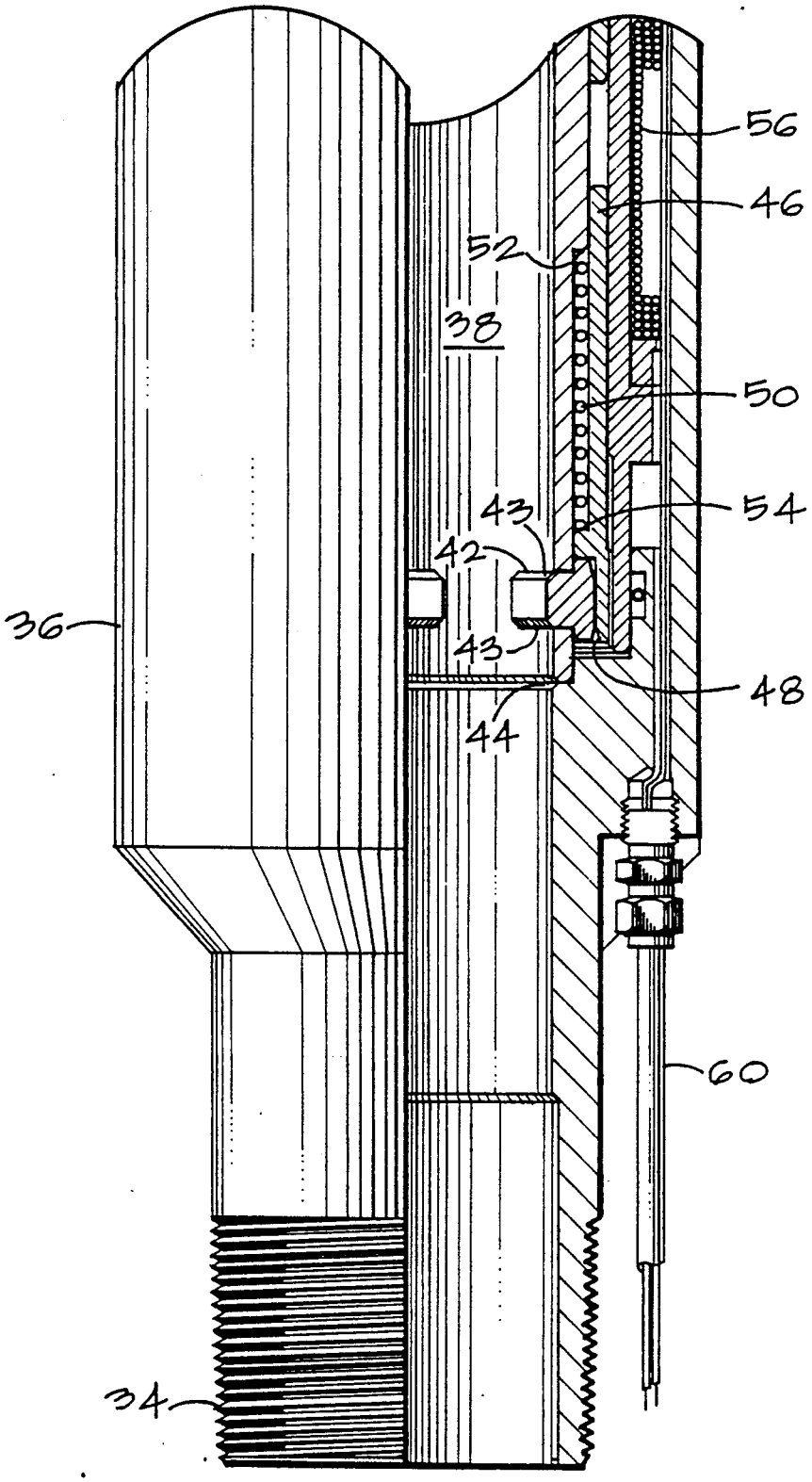
Figure 3:
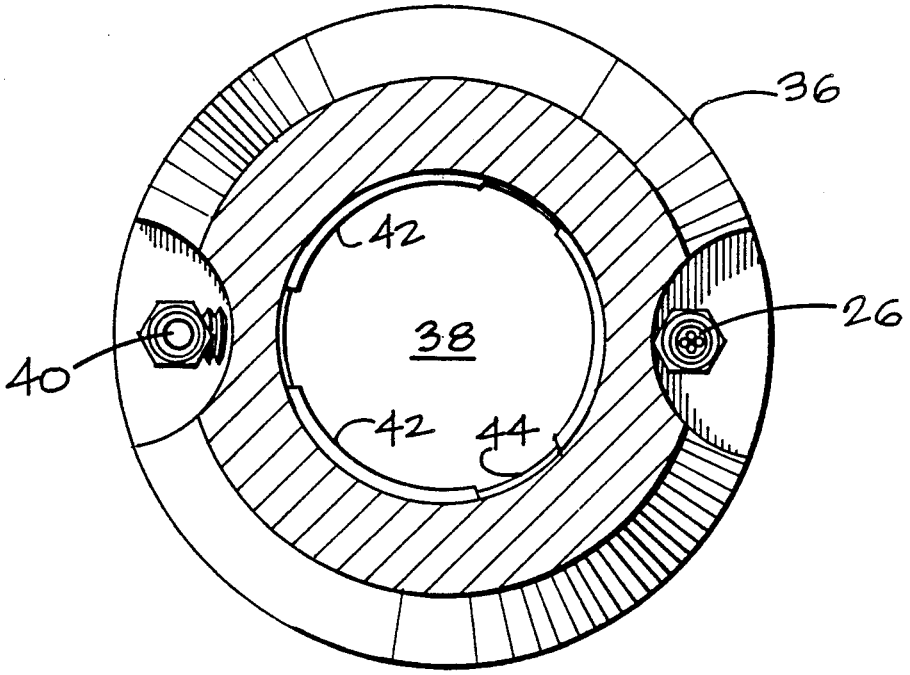
FIG. 3 is a cross-sectional view taken along the line 3—3 of FIG. 2A.

Referring now to FIGS. 2A and 2B and 3, one embodiment of a landing nipple 30 according to the present invention is best seen for receiving a well tool such as a safety valve of FIGS. 4A and 4B which will be more fully described hereinafter. The landing nipple 30 includes threads 32 and 34 at each end for installation in the well tubing 14 of FIG. 1, includes a housing 36, and an open bore 38 for alignment with the well tubing 14. For use with a hydraulically operated safety valve, a hydraulic control line 40 is provided in communication with the bore 38 and leads to the well surface for connection to control fluid.

Referring to FIG. 2B, a first holding shoulder 42, preferably a plurality such as three, and a second holding shoulder 44 are provided. Shoulder 44 may be a permanent no-go shoulder which extends slightly into the bore 38 for engaging a stop shoulder on a well tool for locating a well tool at a desired position in the nipple 30. The holding shoulder 42 is preferably a plurality of locking dogs which are movable out of the bore 38, but are extendable into the bore 38 for locking a well tool in the nipple 30. When the locking dogs 42 are moved out of the bore 38, they do not restrict the bore 38 but provide a full bore opening for allowing well tools to pass therethrough, but when extended into the nipple bore 38, they will engage and lock a well tool therein. The dogs, when extended into the bore 38, extend further than the no-go shoulder 44. A magnetically actuated means such as an armature 46 is movably positioned in the nipple housing 36 and includes locking means such as a wedge surface 48 for moving over the back side of the dogs 42 for moving them to an extended position. Spring means 50 yieldably act between a shoulder 52 on the housing 36 and a shoulder 54 on the armature 46 for normally locking the dogs 42 in an extended position in the bore 38. In order to move the locking dogs 42 out of the bore 38, a solenoid coil 56 is provided, preferably in the housing 36 and connected to an electrical conductor line 26 leading to the well surface as well as a line 60 leading downwardly to be connected to and actuate other landing nipples. The solenoid 56, when actuated by a power source, such as the portable power pack 20 of FIG. 1, attracts the armature 46, overcomes the spring 50, and moves the locking wedge 48 from behind the locking dogs 42. Because of the beveled faces 43 on both the top and bottom of the locking dogs 42, the dogs may release from a well tool lock therein and/or be moved out of the well bore 38 by any well tools passing through the bore 38. However, it is to be noted that the electrical current only need to be supplied to the solenoid 56 when it is desired to move the dogs 42 out of the bore 38. That is, it is not necessary to provide continuous electrical power to the solenoid 56. The electrical conductor line 26 leading from the well surface may selectively actuate the nipple 30 as distinguished from nipples above or below the nipple 30 by using multiple conductors or other suitable control means.

Since the landing nipple 30 includes a permanent no-go shoulder 44, it will have the disadvantage of providing some restriction into the bore 38 and also must have a smaller diameter shoulder 44 than nipples located in the well tubing 14 above the landing nipple 30 in order to selectively land a well tool in the proper nipple. However, the permanent landing no-go shoulder 44 need not be of a width or area to withstand the installation of a jarring type lock in the landing nipple 30. That is, a well tool needs merely be positioned on the no-go shoulder 44 and it can then be locked in place by the locking dogs 42 without any downward jarring as is conventionally required.

Figure 4A:
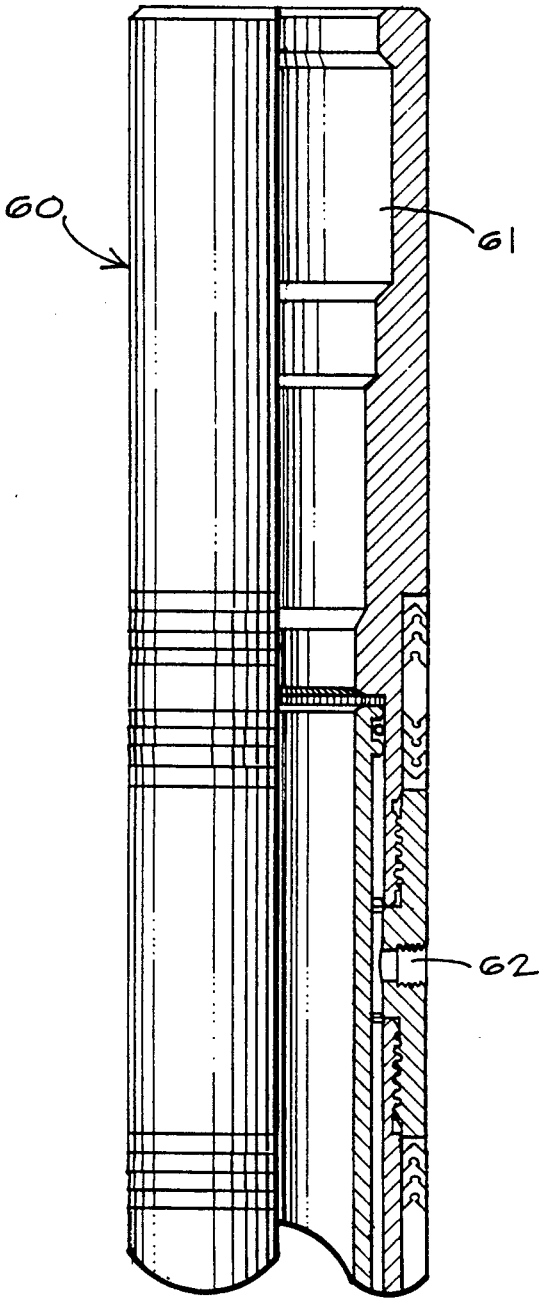
FIGS. 4A and 4B are continuations of each other and are a fragmentary, quarter section, of a part of a conventional safety valve for installation in the landing nipple of FIGS. 2A and 2B.
Figure 4B:
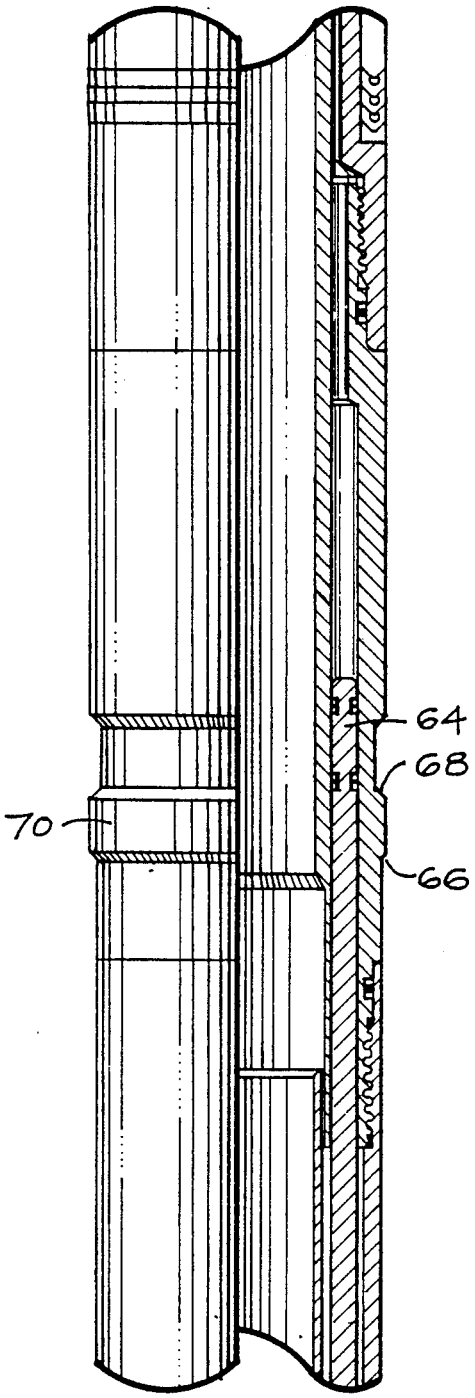

Referring now to FIGS. 4A and 4B, the top half of a well safety valve 60, such as generally disclosed in U.S. Pat. No. 4,161,219, is shown for landing in the landing nipple 30 of FIGS. 2A and 2B. The safety valve 60 includes a hydraulic control fluid port 62 for alignment with the hydraulic line 40 (FIG. 2A) for controlling the actuation of a piston and cylinder assembly 64 for operating the safety valve 60 as is conventional. The valve 60 includes a stop shoulder 66 for coacting with the no-go shoulder 44 (FIG. 2B) of the nipple 30 and a locking recess 68 for receiving the locking dogs 42 (FIG. 2B). The diameter 70 is selected to coact with the no-go shoulder 44.

In operation, the solenoid 56 is energized for retracting the armature 46 and unlocking the wedge surface 48 from behind the locking dogs 42. The safety valve 60 can then be lowered through the well tubing and the bore 38 of the nipple 30 until the stop shoulder 66 contacts and seats on the no-go shoulder 44 of the nipple 30. The solenoid 56 is then deenergized, allowing the spring 50 to move the armature 46 and locking means 48 downwardly to extend the dogs 42 into the locking recess 68 on the safety valve 60. And when it is desired to remove the safety valve 60 from the landing nipple 30, the solenoid 56 is energized to retract the armature 46 and locking wedge 48 from behind the locking dogs 42. Upward movement of the safety valve 60 by a conventional pulling tool will then remove the valve 60 from the nipple 30 without jarring.

If desired, the safety valve 60 could be set in the landing nipple 30 without the need of the no-go shoulder 44 and the stop shoulder 66 on the safety valve 60. That is, with the locking dogs 42 in an extended position in the bore 38, the safety valve 10 could be lowered until it reached and stopped in contact with the locking dogs 42. At this position, it is then located within the nipple 30. The solenoid 56 may be actuated to unlock the locking dogs 42 and allow the safety valve 60 to slowly pass therethrough while at the same time deenergizing the solenoid 56. The spring 50 will then yieldably urge the locking wedges 48 downwardly against the locking dogs 42 which would merely ride over the outside housing of the safety valve 60 until they reached the locking notch 68. At this time, the locking dogs 42 will snap in to the locking recess 68 and be locked in there by the wedge surfaces 48.

Figure 5:
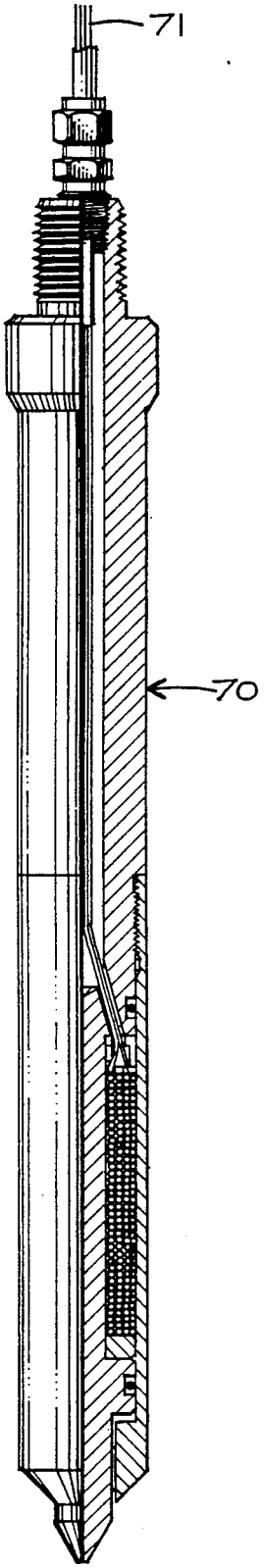
FIG. 5 is an elevational view, in quarter section, of a wireline operated solenoid coil for use in a landing nipple of the present invention.
Figure 6:
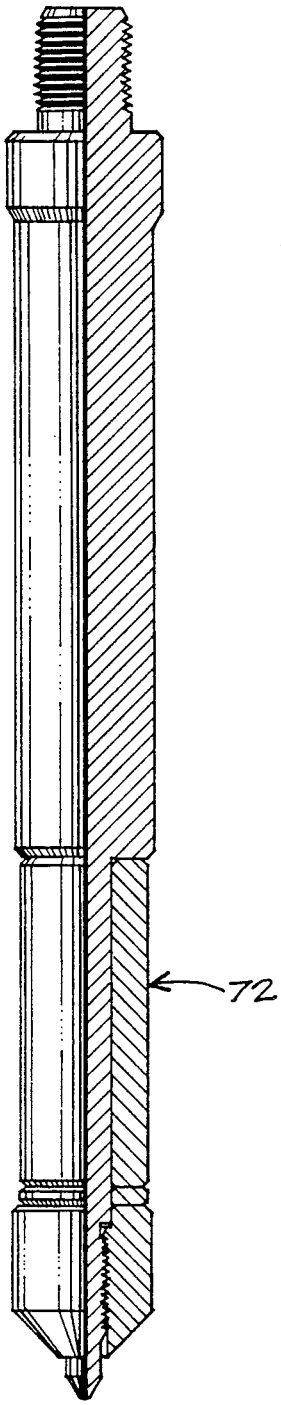
FIG. 6 is a wireline carried magnet for use in a landing nipple of the present invention.

However, in the event that the solenoid 56 or solenoid line 26 fails, emergency pulling tools may be utilized to release the locking dogs 42. Referring to FIG. 5, a solenoid coil tool 70 supported from a conductor line 71 is provided and, as shown in FIG. 6, a permanent magnet tool 72 adapted to supported from a wire line is provided. Either of the tools 70 and 72 may be connected to a pulling tool, such as a Camco Model No. PRS, which engages the recess 61 of the safety valve 60 (FIG. 4A). Thus, either of the tools 70 and 72 can be lowered into the bore of the nipple 30 and the bore of the safety valves 60 and adjacent the armature 46 for attracting the armature 46 upwardly and releasing the locking dogs 42. In fact, if desired, the tools 70 and 72 can be used with a running tool for operating the locking dogs 42 when the safety valve 60 is installed into the landing nipple 30.

Figure 7A:
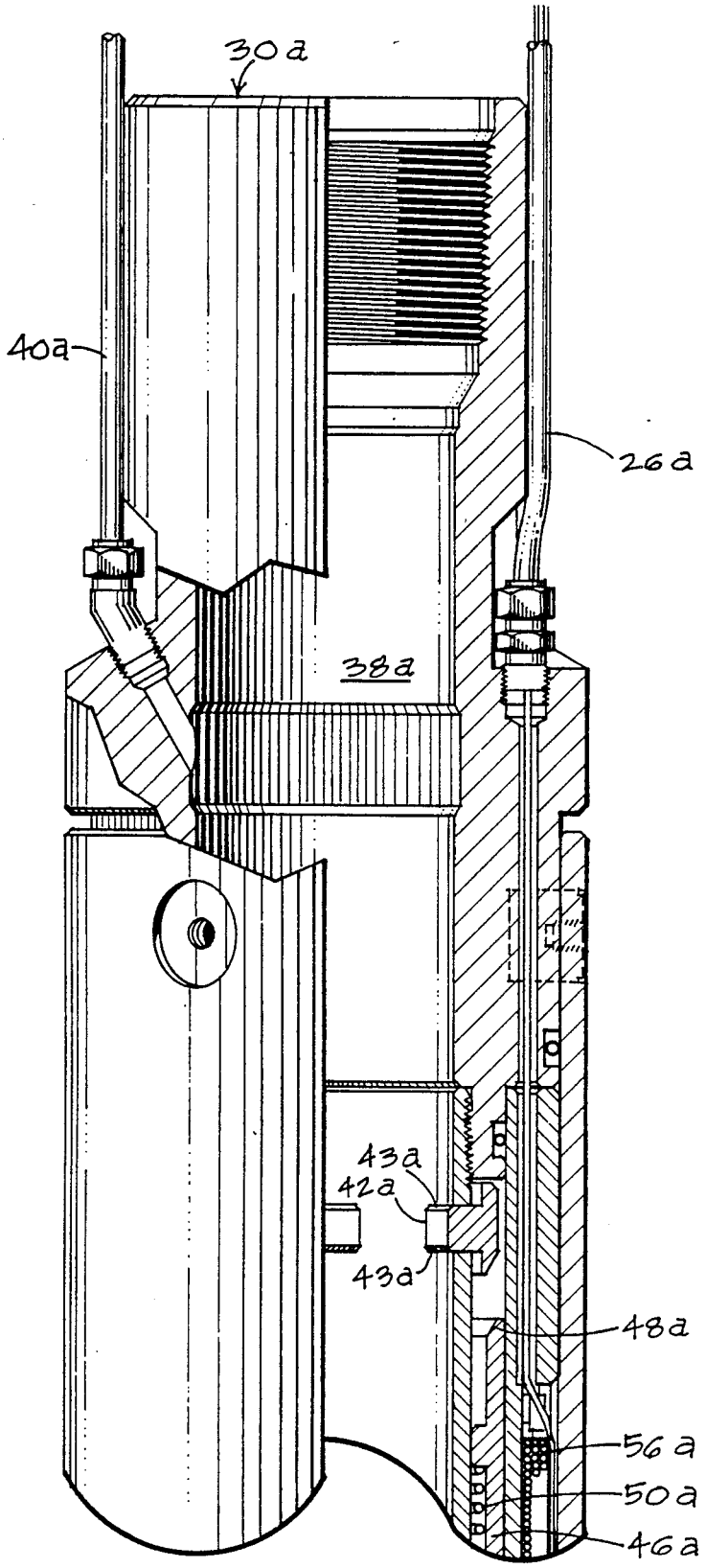
FIGS. 7A and 7B are continuations of each other and are an elevational view, in quarter section, of a further embodiment of a landing nipple of the present invention.
Figure 7B:
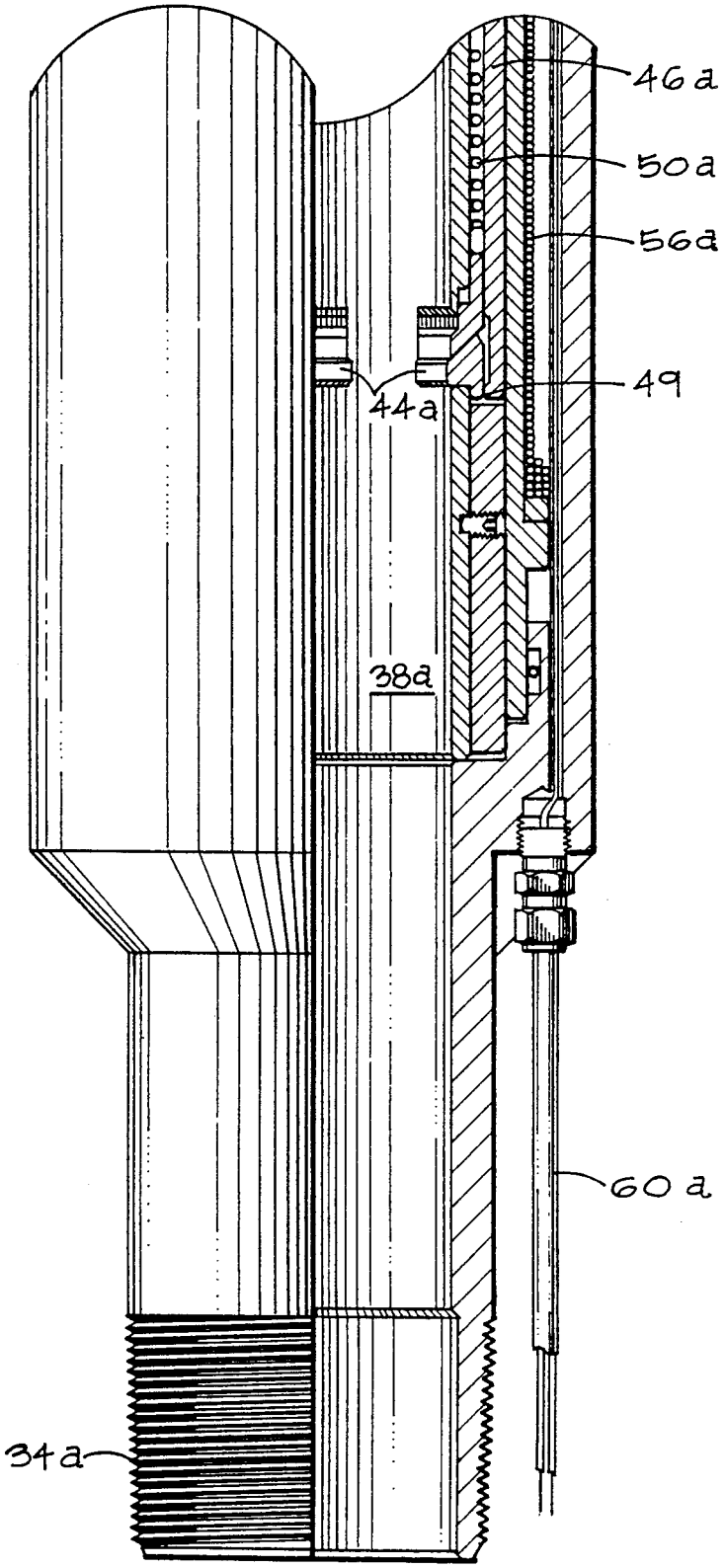

Other and further embodiments may be provided, as hereinafter described, where like parts to those shown in FIGS. 2A and 2B will be similarly numbered with the addition of the suffix "a", "b", "c" and "d". Referring now to FIGS. 7A and 7B, a landing nipple **30*a* is shown having at least one first holding shoulder, preferably a plurality of locking dogs 42*a*, and at least one second holding shoulder, preferably a plurality of no-go shoulders 44*a*. Both the first shoulder 42*a* and the second shoulder 44*a* are movable out of the nipple bore 38*a* for allowing well tools to pass therethrough and are also extendable into the nipple bore 38*a* for engagement with a well tool. A first locking means, such as wedge surfaces 48*a*, are provided for locking and holding the first locking dogs 42*a* in an extendable position in the bore 38*a*. Second locking means, such as surface 49, is provided for holding said second holding shoulder or no-go shoulders 44*a*, in an extendable position in the bore 38*a*. Preferably, a magnetically actuated means, such as armature 46*a*, is connected to both the first and second locking means 48*a* and 49, and is adapted to be actuated from the well surface for unlocking the first and second unlocking means 48*a* and 49, respectively. As best seen in FIGS. 7A and 7B, the solenoid 56*a* is energized thereby actuating the armature 46*a* in direction for moving the second locking means 49 behind the no-go shoulders 44*a* and extending them outward into the bore 38*a*, and at the same time, withdrawing the first locking shoulders 48*a*** from behind the locking dogs 42*a*, thereby allowing the dogs 42*a* to be moved out of the bore 38*a*. When the solenoid 56*a* is deenergized, the spring 50*a* withdraws the second locking means 49 from behind the no-go shoulders 44*a* and yieldably urges the first locking means 48*a* against the back of the locking dogs 42*a*.

A well tool, such as the safety valve 60 of FIGS. 4A and 4B, can be installed in the landing nipple 30*a* of FIGS. 7A and 7B. That is, the solenoid 56*a* is actuated to extend the no go shoulders 44*a* into the bore 38*a* while, at the same time, unlocking the locking dogs 42*a*. The safety valve 60 is lowered in the well bore and through the nipple 30*a* until the stop shoulder 66 contacts the no go shoulders 44*a*. Because the locking notch 68 is closer to the stop shoulder 66 than the spacing of the locking dogs 42*a* and the no go shoulders 44*a*, the locking dogs 44*a* will not be aligned with the locking recess 68. However, by deenergizing the solenoid, the spring 50*a* moves the armature 46*a* upwardly and causes the wedge surfaces 48*a* to act on the back of the locking dogs 42*a* and urge them into contact with the outer housing of the safety valve 60. The safety valve 60 is slowly raised until the locking dogs are aligned with the recess 68, at which time they snap into place and lock the safety valve 60 in the landing nipple 30*a*. In order to release the safety valve 60 from the landing nipple 30*a*, the solenoid 56*a* is energized thereby unlocking the locking dogs 42*a* and the safety valve 60 may be conventionally removed from the bore 38*a* by wireline tools.

Therefore, the landing nipple 30*a* has the same advantages of the landing nipple 30 in FIGS. 2A and 2B in that a well tool 60 may be set in or released from the nipple 30*a* without requiring mechanical jarring of the tool for actuating locking dogs.

However, the nipple 30*a* has the advantage over the embodiment of FIGS. 2A and 2B in that all of the nipples 1, 2, 3, 4, and 5 in FIG. 1 may be identical to landing nipple 30*a* as the locking dogs 42*a* and no-go shoulders 44*a* may be alternately retracted for allowing the passage of well tools through the bores 38*a*. On the other hand, because of the permanent no-go shoulder 44 in the embodiment of FIGS. 2A and 2B, each of the nipples 1, 2, 3, 4 and 5 would be different and must be installed properly in sequence. Furthermore, the bore 38*a* of nipple 30*a* is not restricted by permanent no-go shoulders. If required, a well tool in the nipple 30*a* could be emergency released by the solenoid coil 70 of FIG. 5 or the magnetic tool 72 of FIG. 6.

Figure 8A:
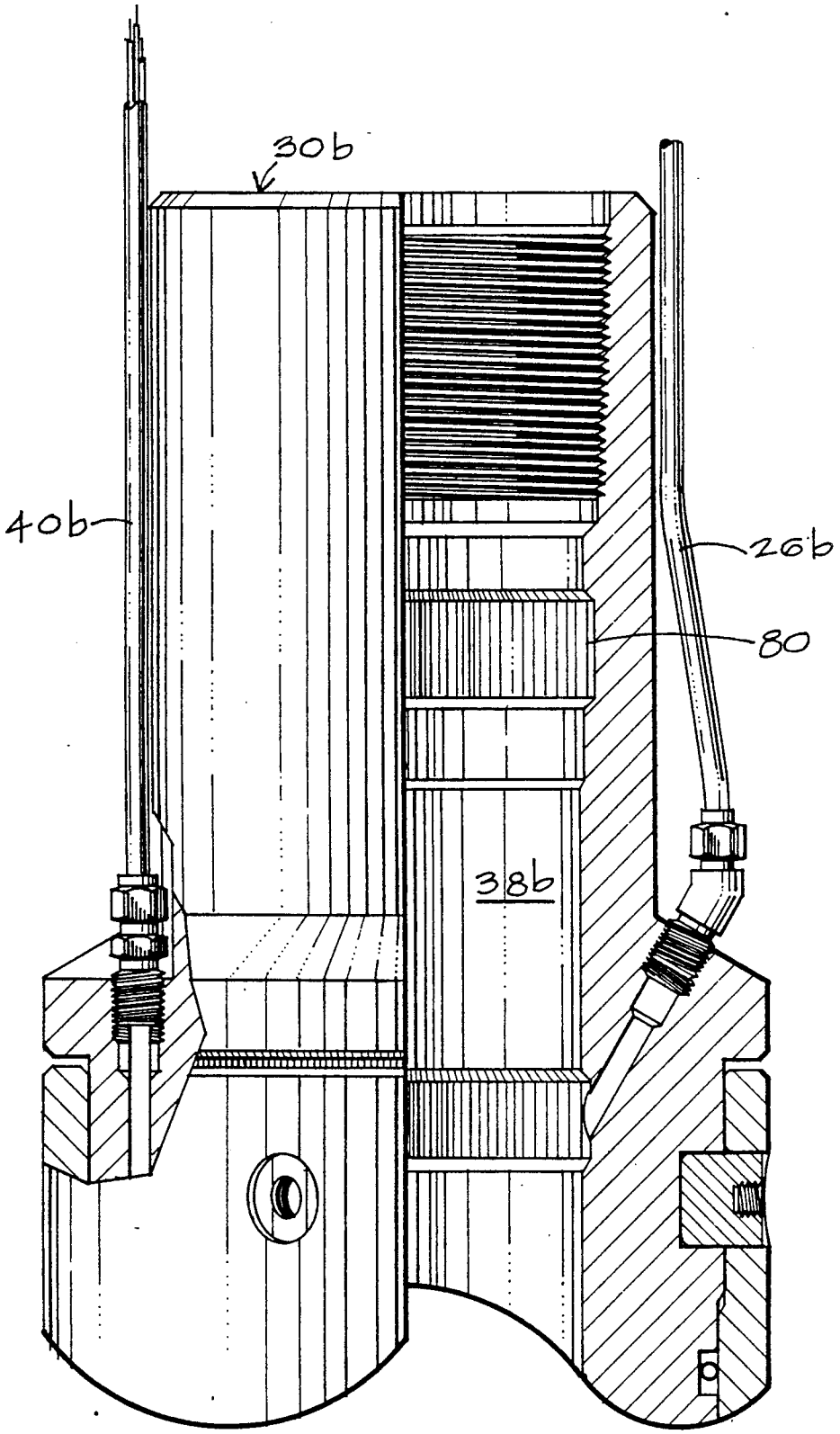
FIGS. 8A and 8B are continuations of each other and are an elevational view, in quarter section, of still a further embodiment of the present invention.
Figure 8B:
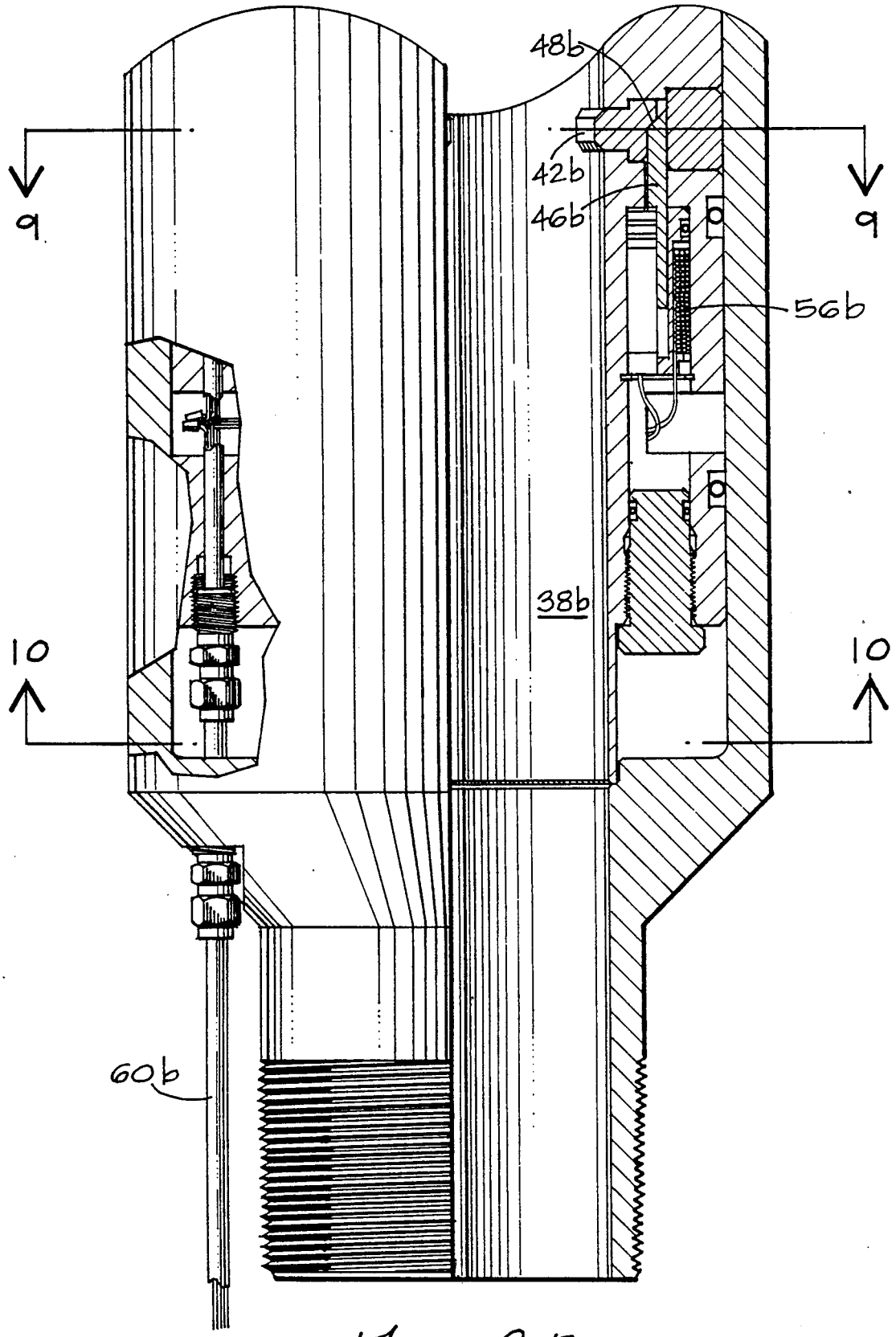
Figure 9:
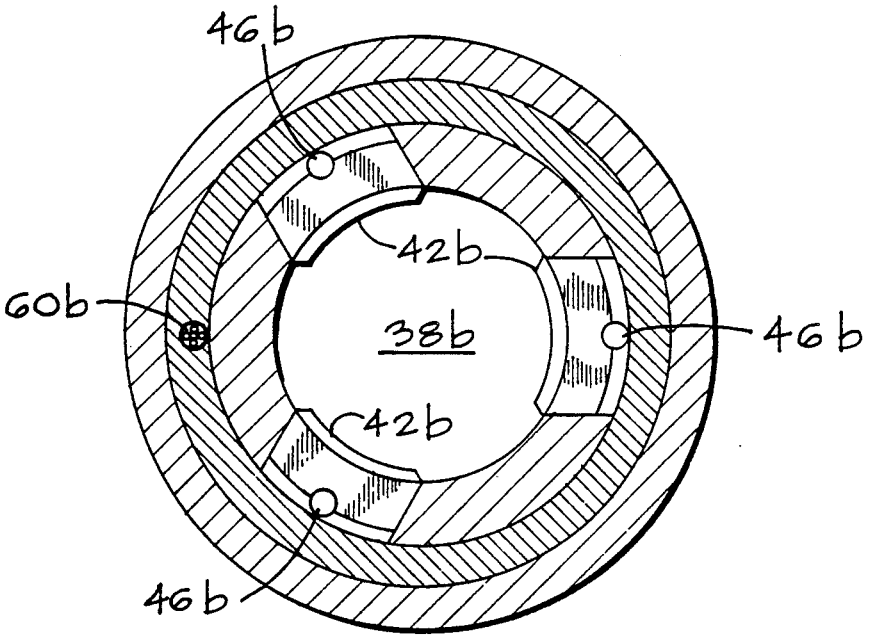
FIG. 9 is a cross-sectional view taken along the line 9—9 of FIG. 8B.
Figure 10:
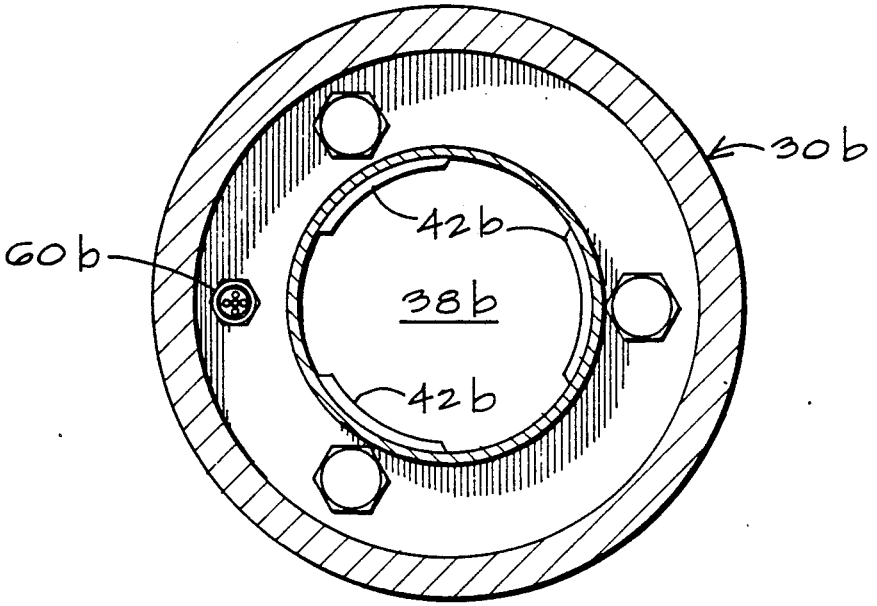
FIG. 10 is a cross-sectional view taken along the line 10—10 of FIG. 8B, FIGS. 11A and 11B are continuations of each other and are a fragmentary elevational view, in quarter section, of a mechanical set well lock supporting a well tool for setting in a landing nipple.

Referring now to FIGS. 8A and 8B, a landing nipple 30*b* is shown having a holding shoulder, such as a plurality of shoulders, here shown as three shoulders, 42*b* which are movable out of the bore 38*b*, and extendable into the bore 38*b*, for engaging a well tool. A separate movable magnetic armature 46*b* is provided for each of the shoulders 42*b* and each armature includes a wedge 48*b* for engaging the back side of the shoulders 42*b*. Thus, actuation of the solenoids 56*b* extend the shoulders 42*b* into the bore 38*b* to provide a no go upon which a well tool may engage and be jarred downwardly to be set and locked into a locking recess 80 (FIG. 8A) by a conventional well lock. The landing nipple 30*b* has the advantage of being selectively operated by the electrical line 26*b* to provide a full open bore for well tools that pass therethrough but which can be selectively actuated to provide a no-go for a desired well tool. While a single solenoid 56*b* could be utilized to actuate all of the shoulders 42*b* as in prior embodiments, it is advantageous to provide separate armatures 46*b* and separate solenoids 56*b* which encircle the armatures 46*b*. If one of the solenoids 56*b* shorts out, the others will provide a sufficient no-go for landing a well tool in the landing nipple. Secondly, normally, in using solenoid coils, the housing is made of non-magnetic stainless steel which is quite expensive. By encircling the armatures 46*b* with the solenoid coils 56*b*, the nipple can be made of an iron material and therefore inexpensive.

Figure 11A:
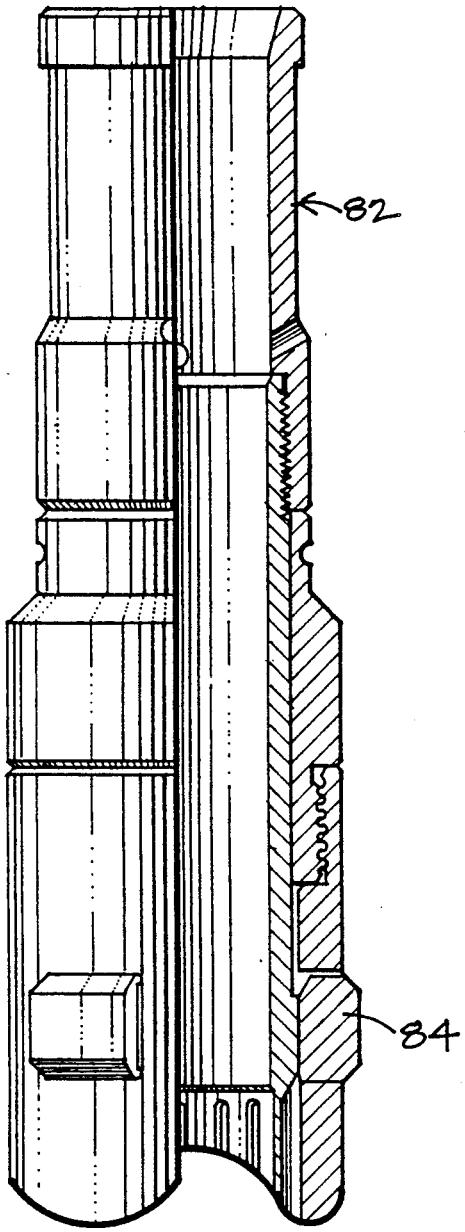
Figure 11B:
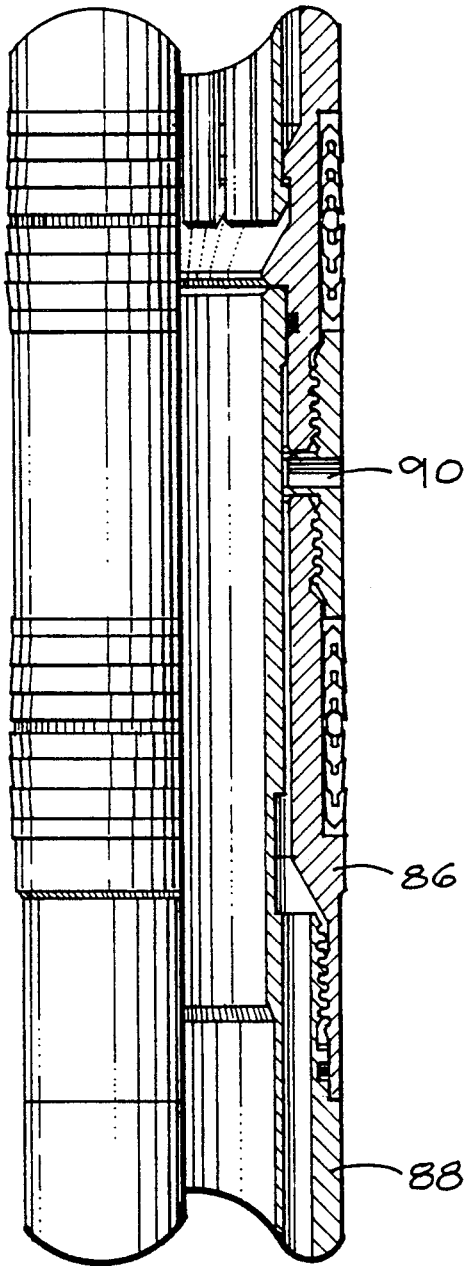

Referring now to FIGS. 11A and 11B, a conventional running tool and lock, such as a Camco "D" lock 82 is best seen for landing on the expanded shoulders 42*b* in the nipple 30*b* of FIGS. 8A and 8B and thereafter being mechanically jarred downwardly to be set and locked in the locking notch 80 (FIG. 8A) of the nipple 30*b*. The lock 82 includes locking dogs 84 here shown in an expanded position, and a no go shoulder 86. The lock 82 carries a conventional well safety valve 88 and includes a hydraulic fluid control port 90 for receiving hydraulic control fluid from the line 40*b* of the nipple 30*b*. The well running tool and lock 82 may be lowered through the well tubing 14 and into a nipple 30*b* in which the stop shoulder 86 is positioned on and rests on the extended shoulders 42*b*. Thereafter, the running tool 82 is jarred downwardly to expand the dogs 84 out into the locking notch 80 in the nipple 30*b*. Thus, the landing nipple 30*b* may replace 5 conventional landing nipples by having a full bore opening but can still provide retractable no-go shoulders for landing a well tool.

Figure 12A:
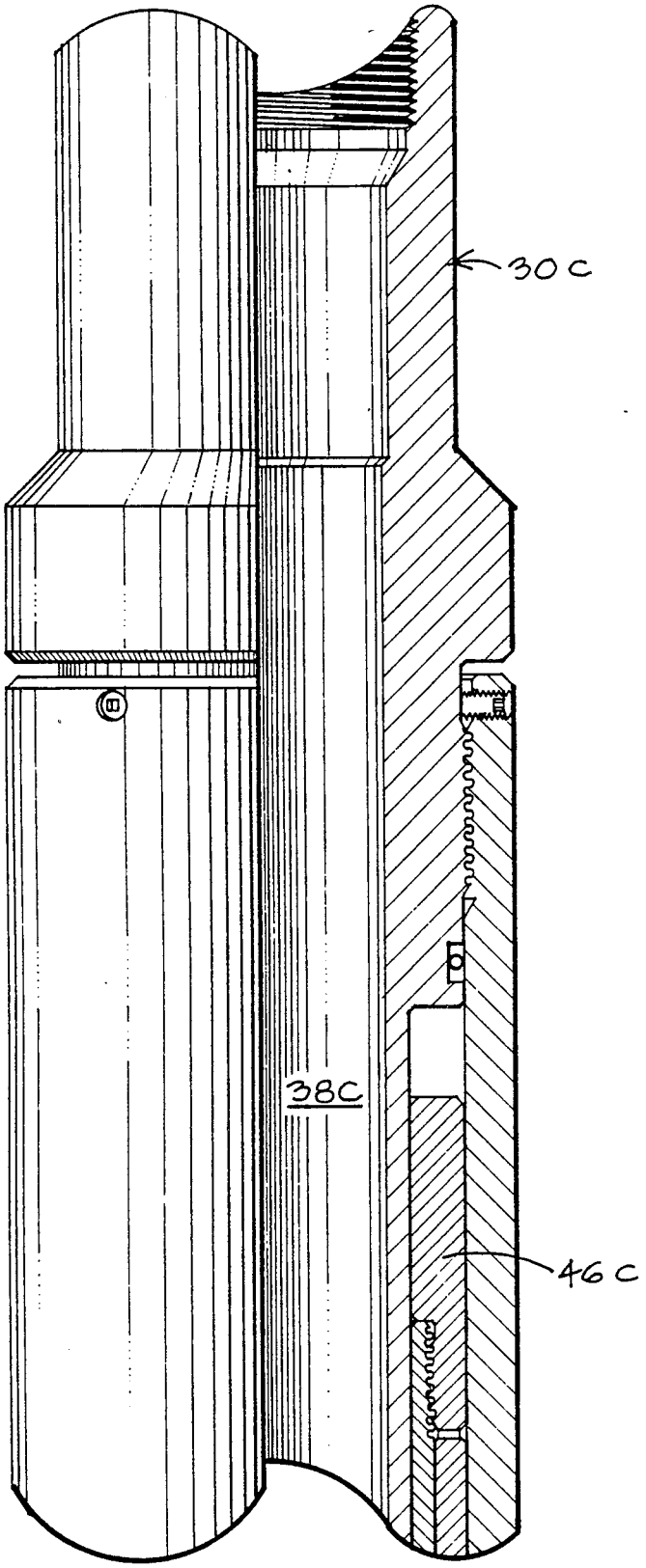
FIGS. 12A and 12B are continuations of each other and are an elevational view, in cross section, of another embodiment of a landing nipple according to the present invention.
Figure 12B:
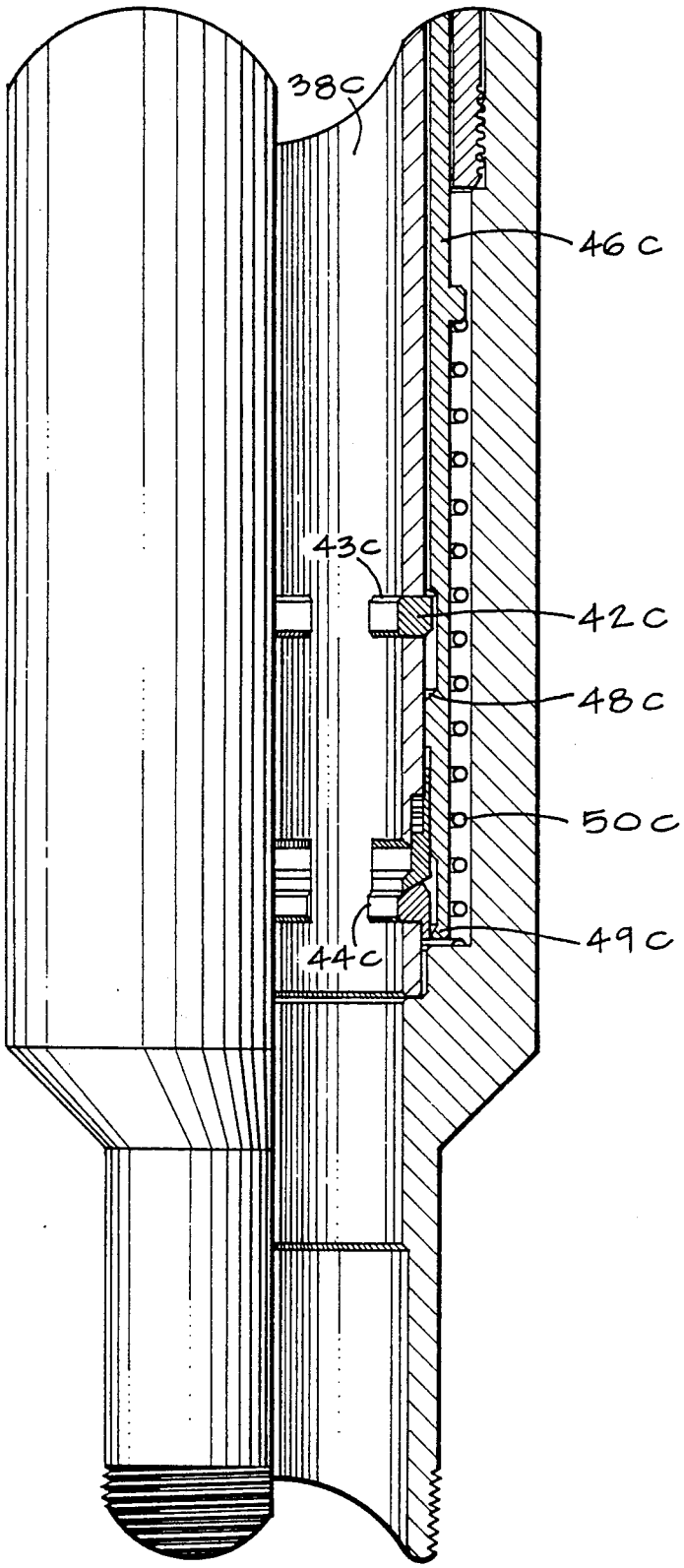
Figure 13A:
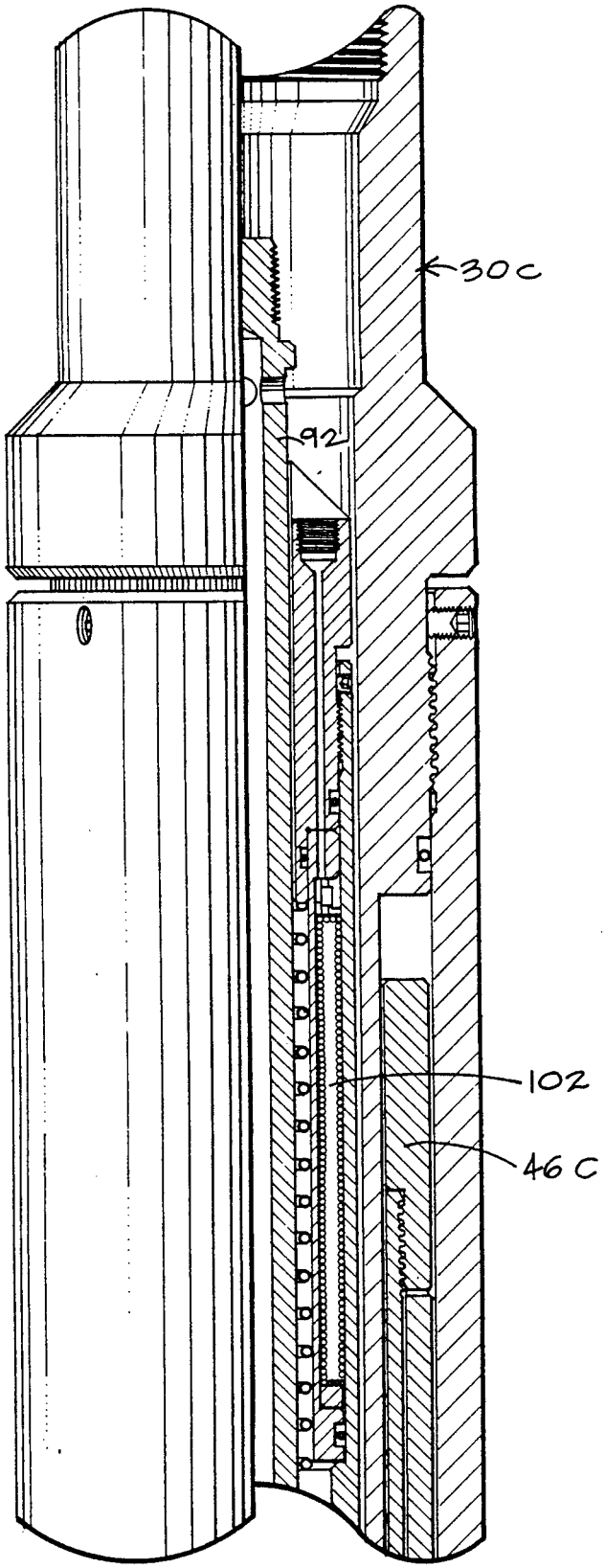
FIGS. 13A and 13B are continuations of each other and are an elevational view, in quarter section, of a well tool being released from the landing nipple illustrated in FIGS. 12A and 12B, and FIGS. 14A and 14B are continuations of each other and are an elevational view, in quarter section, of yet a still further embodiment of a landing nipple of the present invention.
Figure 13B:
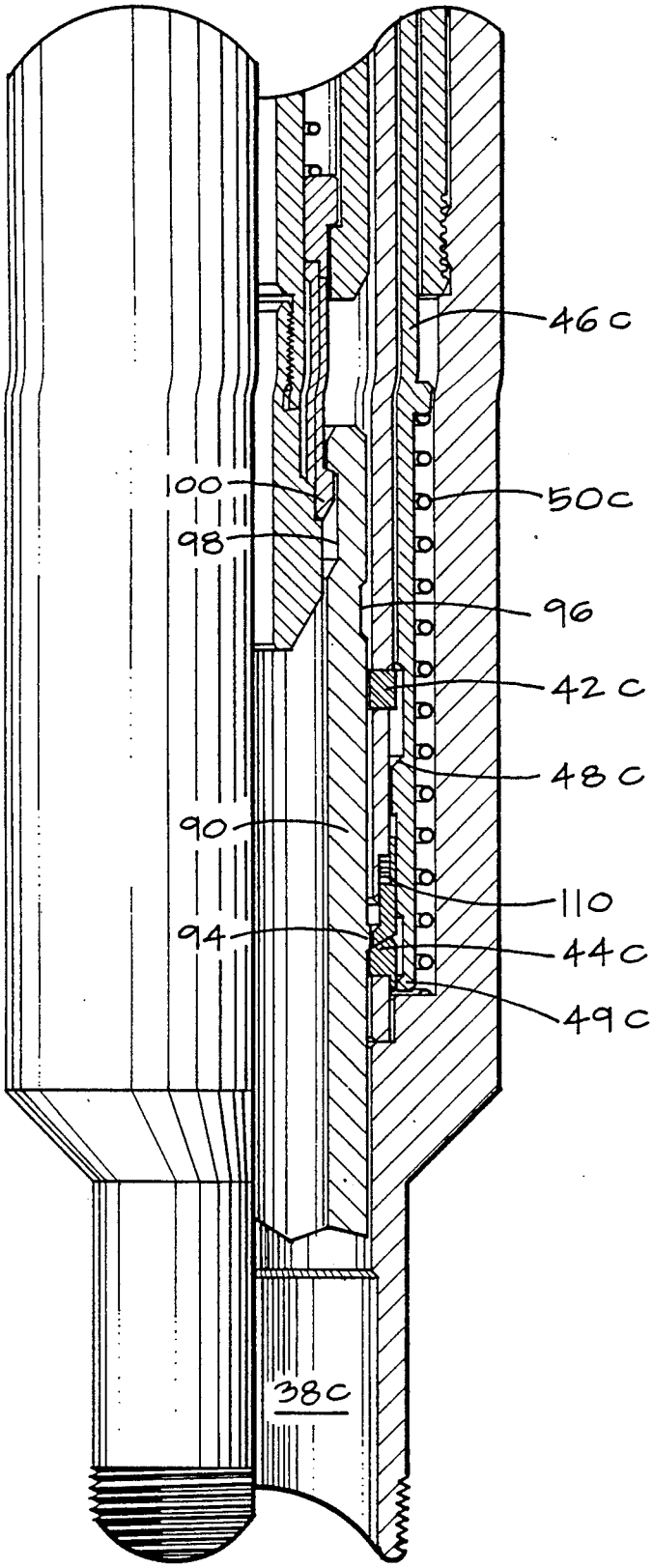

Referring now to FIGS. 12A and 12B, the landing nipple 30*c*, like FIGS. 7A and 7B, include a plurality of first holding shoulders, such as a plurality of locking dogs 42*c*, and a plurality of second holding shoulders, such as no-go shoulders 44*c*. Both the locking dogs and the no-go shoulders are movable out of the bore 38*c* for allowing well tools to pass therethrough and are extendable into the bore 38*c* for engagement with a well tool. An armature 46*c* is movable in the nipple and is connected to first locking means, such as wedge shoulders 48*c*, and second locking means, such as shoulder 49*c*, for locking the dogs 42*c* and no-go shoulders 44*c* in an extended position, respectively. Spring means 50*c* in the nipple 30*c* act in a direction for locking the locking dogs 42*c* in an extended position and unlocking the no-go shoulders 44*c*. However, in the embodiment of landing nipple 30*c*, there is no electromagnetic means, such as a solenoid coil, positioned in the nipple to actuate the armature 44*c*. The means for actuating the armature 46*c* is provided in the running and pulling tools which install or remove a well tool from a nipple 30*c*. Thus, as best seen in FIG. 13A and 13B, a well tool, a portion of which is indicated by reference numeral 90, is shown being pulled from the nipple 30*c* by a pulling tool, generally indicated by the reference numeral 92. The well tool 90 includes a no-go shoulder 94, and a locking recess 96 and a pulling recess 98. The pulling tool 92 includes a spring loaded pulling collet 100 which is shown as being engaged in the recess 98 and is in the process of pulling the well tool 90 upwardly. In addition, the pulling tool 92 includes a solenoid coil 102. The pulling tool 92 is lowered on a conductor line (not shown) for mechanically raising and lowering the pulling tool 92 and also for energizing the solenoid coil 102 for activating the armature 46*c*. Initially, when the well tool 90 is inserted into the nipple 30*c* on a setting tool (not shown), the well tool 90 is lowered into the well bore 38*c*. Since the armature 46*c* is, at this time, not energized, the locking dog 42*c* will be extended outwardly into the bore 38*c*, but the no-go shoulders 44*c* will be retracted. Upon lowering the well tool 90, the no-go shoulder 94 will contact the locking dogs 42*c*, which are locked outwardly by locking means 48*c*. Then a solenoid coil on the setting tool will be actuated to move the armature 46 downwardly releasing the locking dogs 42*c* but extending the no-go dogs 44*c*. The tool 90 can then be lowered until the no-go shoulder 94 contacts the extended no-go shoulder 44*c*. The solenoid is then deenergized allowing the armature 46*c* to be moved upwardly in response to the spring 50*c* yieldably urging the locking dogs 42*c* outwardly, but releasing the no-go dogs 44*c*. This allows the no-go shoulders 94 to move downwardly below the no-go shoulder 44*c* and allows the locking dogs 44*c* to become aligned with and spring into the locking recess 96. Upon inserting the pulling tool 92, as best seen in FIGS. 13A and 13B, the solenoid 102 is actuated to move the armature 46*c* downwardly to unlock the locking dogs 42*c* for allowing the well tool 90 to be pulled upwardly by the pulling tool 92. The no-go shoulders 94, which are initially below the no-go shoulders 44*c*, will contact the no-go shoulders 44*c*, moving them upwardly against a load spring 110, allow the no-go shoulders to move outwardly and away from the locking shoulder 49*c* whereby the stop shoulders 94 can move upwardly. Thereafter, the pulling tool 92 may remove the well tool 90 from the well landing nipple 30*c*.

Figure 14A:
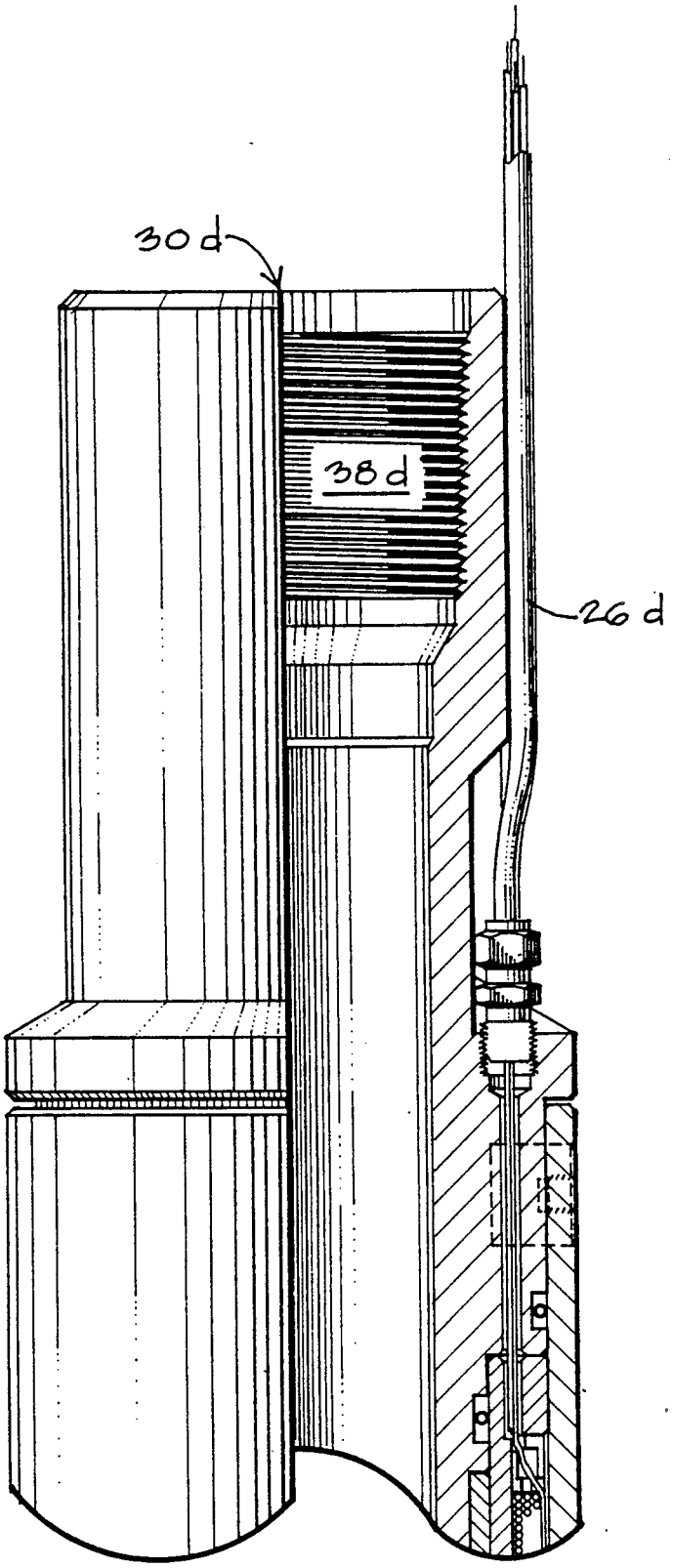
Figure 14B:
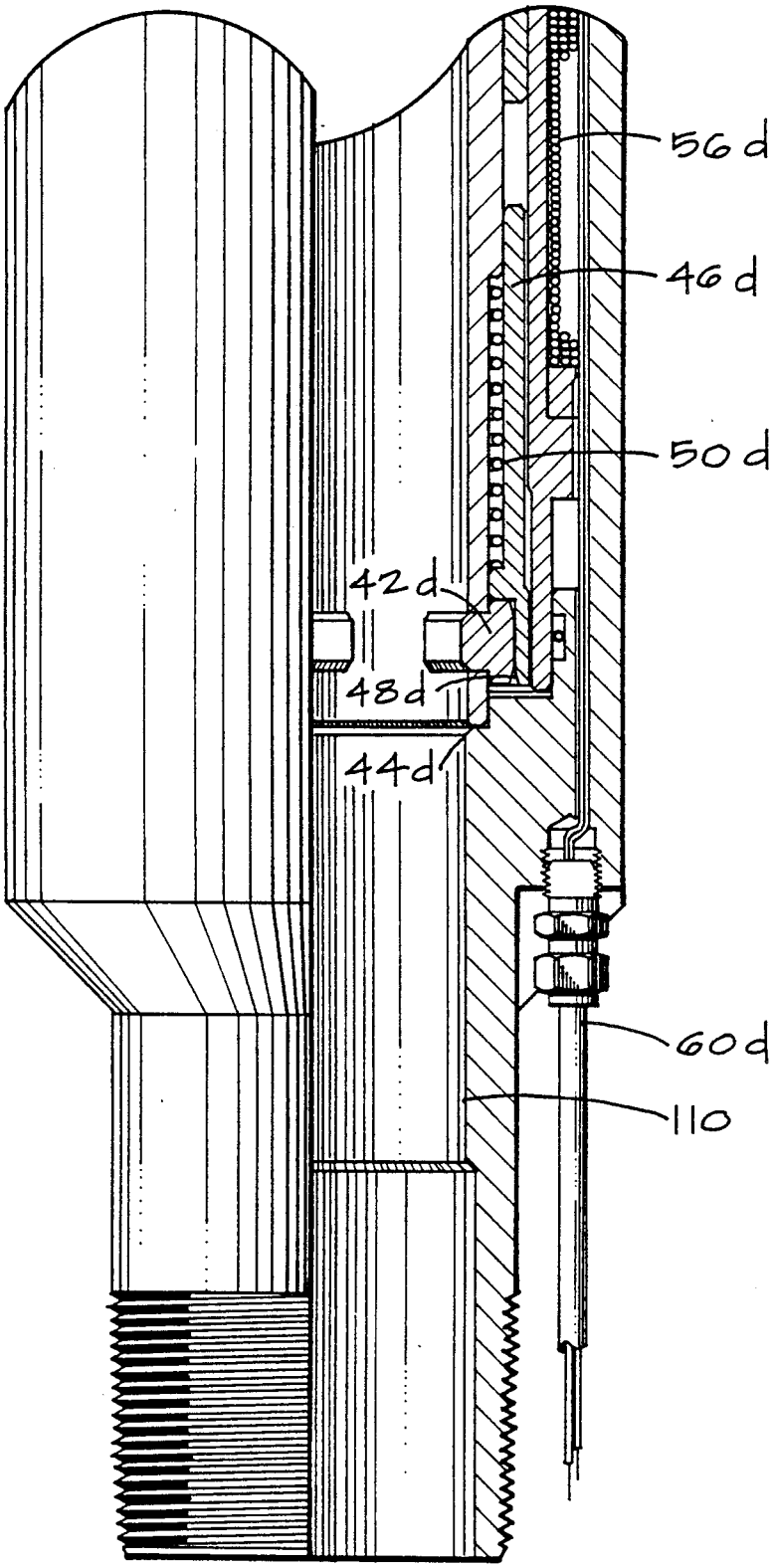

Referring now to FIGS. 14A and 14B, a nipple 30*d* is shown which is similar to that shown in FIGS. 2A and 2B, except instead of having a hydraulic inlet, the nipple 30*b* includes preferably a polished sealing bore 110 for receiving a seal on a measuring instrument. In any event, the landing nipple 30*d* receives a instrument well tool and operates generally similar to that described in connection with the landing nipple 30 in FIGS. 2A and 2B. That is, an instrument tool may be lowered on a wireline through the bore 38*d* of the landing nipple 30*d*, the solenoid coil 56*d* is actuated to release the locking dogs 42*d* and the instrument package is landed on the permanent no-go shoulder 44*d*. Thereafter, the solenoid 56 is deactuated and the locking dogs 42*d* will be forced inwardly by the wedge surface 48*b* to engage a locking recess in the instrument well tool. It is to be noted that the instrument well tool need not be jarred downwardly for locking in the landing nipple 30*d*. Furthermore, when it is desired to release the instrument well tool, the solenoid 56*d* merely needs to be energized which releases the locking dogs 42*d* allowing the removal of the instrument well tool on a conventional wireline without any upward jarring.

The present invention, therefore, is well adapted to carry out the objects and attain the ends and advantages mentioned as well as others inherent therein. While presently preferred embodiments of the invention have been given for the purpose of disclosure, numerous changes in the details of construction and arrangement of parts, and steps of the process will readily suggest themselves to those skilled in the art and which are encompassed within the spirit of the invention and the scope of the appended claims.

What is claimed is:

1. A landing nipple for connection in a well tubing for receiving a well tool movable through the well tubing, said nipple including an open bore for alignment with the well tubing comprising, at least one holding shoulder in said nipple, said shoulder movable out of the nipple bore for allowing well tools to pass therethrough and extendable into the nipple bore for engagement with a well tool movable through the open bore of the nipple, locking means in the nipple for locking said holding shoulder in an extendable position in the bore, and magnetically actuated means connected to the locking means and adapted to be actuated from the well surface for unlocking the locking means.

2. The apparatus of claim 1 wherein the locking means and magnetically actuated means includes, a movable magnetic armature including a wedge for engaging, moving, locking and unlocking said holding shoulder, and spring means for moving the armature in a direction to lock the holding shoulder in an extendable position, and a solenoid adapted to actuate the armature for unlocking the locking means.

3. The apparatus of claim 2 wherein the solenoid is positioned in the nipple.

4. The apparatus of claim 2 wherein the solenoid is connected to a line from the well surface and the solenoid is movable in the bore of the nipple.

5. The apparatus of claim 1 including a no-go shoulder in the bore of the nipple extending inwardly for engaging a well tool.

6. The apparatus of claim 5 wherein the holding shoulder is extendable into the bore further than the no-go shoulder.

7. The apparatus of claim 1 wherein the locking means and magnetically actuated means includes, a movable electrical armature including a wedge for engaging, moving, locking, and unlocking said holding shoulder, spring means for moving said armature in a direction to lock the holding shoulder in an extendable position, and a magnet connected to a line from the well surface and movable through the bore of the nipple for actuating the armature.

8. The apparatus of claim 6 including a well tool having a stop shoulder for engaging the no-go shoulder and having a locking recess for receiving the holding shoulder.

9. The method of setting a well tool having a stop shoulder and a locking recess in a nipple in a well tubing in which the nipple includes a bore, a no-go shoulder extending into the bore, and at least one holding shoulder which is movable out of the bore and is extendable into the bore and which is normally locked in the extendable position by locking means, comprising, magnetically energizing and retracting the locking means whereby the holding shoulder may be moved from the bore, lowering a well tool into the well tubing and nipple and positioning the stop shoulder on the no-go shoulder, magnetically deenergizing the locking means and locking the holding shoulder in an extendable position in the locking recess.

10. The method of claim 9 wherein the locking means is selectively retracted by a solenoid coil positioned in the nipple and actuating the coil from the well surface.

11. The method of claim 10 including retrieving the set well tool comprising, magnetically energizing and retracting the locking means, and raising the well tool from the nipple and well tubing.

12. The method of claim 11 wherein electrically energizing the locking means includes, lowering an electrical solenoid coil into the bore of the nipple, and actuating the solenoid coil from the well surface.

13. The method of claim 10 including retrieving the set well tool comprising, magnetically energizing and retracting the locking means by lowering a magnet into the bore of the nipple, and raising the well tool from the nipple and well tubing.

14. A landing nipple for connection in a well tubing, said nipple including an open bore for alignment with the well tubing comprising, at least one first holding shoulder in said nipple, said first shoulder movable out of the nipple bore for allowing well tools to pass therethrough, and extendable into the nipple bore for engagement with a well tool, first locking means in the nipple for locking said first holding shoulder in an extendable position in the bore, at least one second holding shoulder in said nipple, said second shoulder axially spaced from the first shoulder, said second shoulder movable out of the nipple bore for allowing well tools to pass therethrough, and extendable into the nipple bore for engagement with a well tool, second locking means in the nipple for locking said second holding shoulder in an extendable position in the bore, and magnetically actuated means connected to the first and second locking means and adapted to be actuated from the well surface for unlocking the first and second locking means.

15. The apparatus of claim 14 wherein the magnetically actuated means in one position unlocks one of the locking means and in a second position unlocks the other of the locking means.

16. The apparatus of claim 14 wherein the first holding shoulder is a locking dog and the second holding shoulder is a no-go, and said locking dog is extendable into the bore further than the no-go shoulder.

17. The apparatus of claim 14 wherein the locking means and the magnetically actuated means includes, a movable magnetic armature including wedge means for engaging, moving, locking, and unlocking said first and second holding shoulders, spring means for moving the armature in a direction to lock the first holding shoulder and unlock the second holding shoulder, a solenoid adapted to actuate the armature in a direction to unlock the first holding shoulder and lock the second holding shoulder.

18. The apparatus of claim 17 wherein the solenoid is positioned in the nipple.

19. The apparatus of claim 16 including a well tool having a stop shoulder for engaging the no-go and a locking recess for receiving the locking dog.

20. A landing nipple for connection in a well tubing, said nipple including an open bore for alignment with the well tubing comprising, a plurality of first holding shoulders in said nipple, said first shoulders movable out of the nipple bore for allowing well tools to pass therethrough, and extendable into the nipple bore for engagement with a well tool, a plurality of second holding shoulders in said nipple positioned below and spaced from the first shoulders, said second shoulders movable out of the nipple bore for allowing well tools to pass therethrough, and extendable into the nipple bore for engagement with a well tool, a magnetically actuated armature movable in said nipple between first and second positions, first and second locking means connected to the armature for alternately locking and unlocking said first and second shoulders, respectively, in and from an extendable position in the bore, spring means in the nipple acting on the armature in a direction for locking said first shoulders and unlocking said second shoulders, solenoid means positioned to actuate the armature in a direction for locking said second shoulders and unlocking said first shoulders.

21. The method of setting a well tool having a stop shoulder and a locking recess in a landing nipple including a bore, a no-go shoulder which is movable and extendable into and out of the bore, and locking dog means positioned above the no-go shoulder, and which are movable and extendable into and out of the bore, and first and second releasable locking means for locking and unlocking said dog means and no-go shoulder, respectively, comprising, magnetically retracting the first locking means for unlocking the dog means and magnetically locking the second locking means for locking said no-go shoulder in an extendable position in the bore, lowering the well tool into the well tubing and nipple and positioning the stop shoulder on the no-go shoulder, unlocking the second locking means, and yieldably urging the first locking means into engagement with the locking dog means.

22. The method of claim 21 including, moving the well tool in the nipple until the locking dog means is aligned with the locking recess.

23. A landing nipple for connection in a well tubing, said nipple including an open bore for alignment with the well tubing comprising, a plurality of holding shoulders at one axial position in said nipple, said shoulders movable out of the nipple bore for allowing well tools to pass therethrough and extendable into the nipple bore for engagement with a well tool, a separate movable magnetic armature including a wedge for engaging, moving, locking and unlocking each of the holding shoulders, spring means for moving each of the armatures in a direction to unlock the holding shoulders, and separate solenoids in the nipple and adapted to be energized from the well surface for separately actuating each of the armatures for locking the holding shoulders in a extendable position.

24. A landing nipple for connection in a well tubing, said nipple including an open bore for alignment with the well tubing comprising, a plurality of first holding shoulders in said nipple, said first shoulders movable out of the nipple bore for allowing well tools to pass therethrough, and extendable into the nipple bore for engagement with a well tool, a plurality of second holding shoulders in said nipple positioned below and spaced from the first shoulders, said second shoulders movable out of the nipple for allowing well tools to pass therethrough, and extendable into the nipple bore for engagement with a well tool, locking and unlocking means in the nipple for selectively locking and unlocking said first and second shoulders and magnetically actuated means in the nipple for selectively actuating the locking and unlocking means.

25. The apparatus of claim 24 wherein the locking and unlocking means magnetically actuated means includes, a movable magnetic armature including wedge means for locking said first and second shoulders in an extendable position in the bore, spring means for moving the armature in a direction to lock the first shoulders while unlocking the second shoulders, and magnetic actuating means for actuating the armature in a direction to unlock the first shoulders while locking the second shoulders.

26. The apparatus of claim 25 wherein said first shoulders are locking dogs and said second shoulders are no-go shoulders and including, second spring means in the nipple yieldably urging the no-go shoulders downwardly into a locked position.

27. The apparatus of claim 25 wherein the magnetic actuating means includes a solenoid coil connected to a line from the well surface and movable in the bore of the nipple.

28. The apparatus of claim 27 wherein the first shoulders are locking dogs, and the second shoulders are no-go shoulders, and the locking and unlocking means and magnetically actuated means includes, a movable magnetic armature having first wedge means for coacting with the locking dogs and second wedge means for coacting with the no-go shoulders.

29. The method of setting a well tool having a stop shoulder and a locking recess in a landing nipple including a bore, no-go shoulders which are movable and extendable into and out of the bore, and locking dog means positioned above the no-go shoulder, and which are movable and extendable into and out of the bore, and first and second releasable locking means for locking and unlocking said dog means and no-go shoulders, respectively, comprising, magnetically retracting the first locking means for unlocking the dog means and magnetically locking the second locking means for locking said no-go shoulders in an extendable position in the bore, lowering the well tool into the well tubing and nipple and positioning the stop shoulder on the no-go shoulders, unlocking the second locking means, and yieldably urging the first locking means into engagement with the locking dog means.

30. The method of claim 29 including, moving the well tool downwardly in the nipple until the locking dog means is aligned with the locking recess.

31. The method of claim 30 wherein the no-go shoulders are moved to a position below the second locking means.

* * * * *